US007778565B2

(12) United States Patent
Baba et al.

(10) Patent No.: US 7,778,565 B2
(45) Date of Patent: Aug. 17, 2010

(54) HEATING DEVICE, FIXING DEVICE, AND IMAGE FORMING DEVICE

(75) Inventors: Motofumi Baba, Kanagawa (JP); Yasuhiro Uehara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 337 days.

(21) Appl. No.: 11/902,296

(22) Filed: Sep. 20, 2007

(65) Prior Publication Data

US 2008/0226324 A1 Sep. 18, 2008

(30) Foreign Application Priority Data

Mar. 16, 2007 (JP) ..... 2007-067991

(51) Int. Cl.
*G03G 15/20* (2006.01)

(52) U.S. Cl. ..... 399/69; 399/333

(58) Field of Classification Search ..... 399/67, 399/69, 107, 320, 328, 329, 330, 333; 219/216, 219/619

See application file for complete search history.

(56) References Cited

U.S. PATENT DOCUMENTS

| | | | | |
|---|---|---|---|---|
| 6,021,303 | A * | 2/2000 | Terada et al. | 399/328 |
| RE38,810 | E | 10/2005 | Terada et al. | |
| 7,329,845 | B2 | 2/2008 | Kagawa | 219/619 |
| 7,466,950 | B2 | 12/2008 | Matsuura et al. | 399/328 |
| 2006/0216080 | A1 * | 9/2006 | Nanjo | 399/333 |
| 2008/0063445 | A1 | 3/2008 | Imai et al. | 399/333 |
| 2008/0124111 | A1 | 5/2008 | Baba et al. | |

FOREIGN PATENT DOCUMENTS

| | | |
|---|---|---|
| JP | 2001-176648 | 6/2001 |
| JP | 3527442 | 2/2004 |
| JP | A-2005-148350 | 6/2005 |
| JP | A-2005-208624 | 8/2005 |
| JP | A-2006-071960 | 3/2006 |

* cited by examiner

*Primary Examiner*—David P Porta
*Assistant Examiner*—Benjamin Schmitt
(74) *Attorney, Agent, or Firm*—Morgan, Lewis & Bockius LLP

(57) ABSTRACT

A heating device includes a magnetic field generating unit, and a heat generating body having a heat generating layer generating heat due to electromagnetic induction, and a temperature-sensitive layer. The heat generating layer is disposed opposing the magnetic field generating unit. The temperature-sensitive layer has a Curie temperature greater than or equal to a set temperature of the heat generating layer and less than or equal to a heat-resistant temperature of the heat generating layer, and is disposed at a side of heat generating layer opposite a side where the magnetic field generating unit is disposed such that heat from the heat generating layer is conducted. At temperatures lower than the Curie temperature, the temperature-sensitive layer causes the magnetic field to penetrate in from the heat generating layer, and at temperatures greater than or equal to the Curie temperature, causes magnetic flux of the magnetic field to pass therethrough.

17 Claims, 6 Drawing Sheets

HEATING DEVICE, FIXING DEVICE, AND IMAGE FORMING DEVICE

CROSS-REFERENCE TO RELATED APPLICATION

This application claims priority under 35 USC 119 from Japanese Patent Application No. 2007-67991 filed Mar. 16, 2007.

BACKGROUND

1. Technical Field

The present invention relates to a heating device, a fixing device, and an image forming device.

2. Related Art

Conventionally, an image forming device, such as a printer, a copier, or the like which carries out image formation by using an electrophotographic method, uses a fixing device which passes a toner image, which has been transferred on a recording sheet, through a nip portion formed by a pressure-applying roller and a fixing roller or a fixing belt which has a heat source such as a halogen heater or the like, and fuses and fixes the toner by the working of the heat and the pressure.

On the other hand, there are fixing devices which utilize an electromagnetic induction heat generating system using, as the heat source, a coil which generates a magnetic field by energization and a heat generating body generating heat due to eddy current arising due to electromagnetic induction of the magnetic field.

SUMMARY

An aspect of the present invention provides a heating device comprising: a magnetic field generating unit that generates a magnetic field; and a heat generating body including a heat generating layer which is disposed so as to oppose the magnetic field generating unit and which generates heat due to electromagnetic induction of the magnetic field, and a temperature-sensitive layer which has a Curie temperature from a set temperature of the heat generating layer to a heat-resistant temperature of the heat generating layer, and which is disposed at a side of the heat generating layer opposite a side at which the magnetic field generating unit is disposed, such that heat from the heat generating layer is conducted; at temperatures lower than the Curie temperature, the temperature-sensitive layer allowing the magnetic field to penetrate into the temperature-sensitive layer from the heat generating layer, and, at temperatures greater than or equal to the Curie temperature, the temperature-sensitive layer allowing magnetic flux of the magnetic field to pass through the temperature-sensitive layer.

BRIEF DESCRIPTION OF THE DRAWINGS

Exemplary embodiments of the present invention will be described in detail based on the following figures, wherein.

DETAILED DESCRIPTION

A first exemplary embodiment of a heating device, a fixing device, and an image forming device of the present invention will be described on the basis of the drawings.

Figure 1:
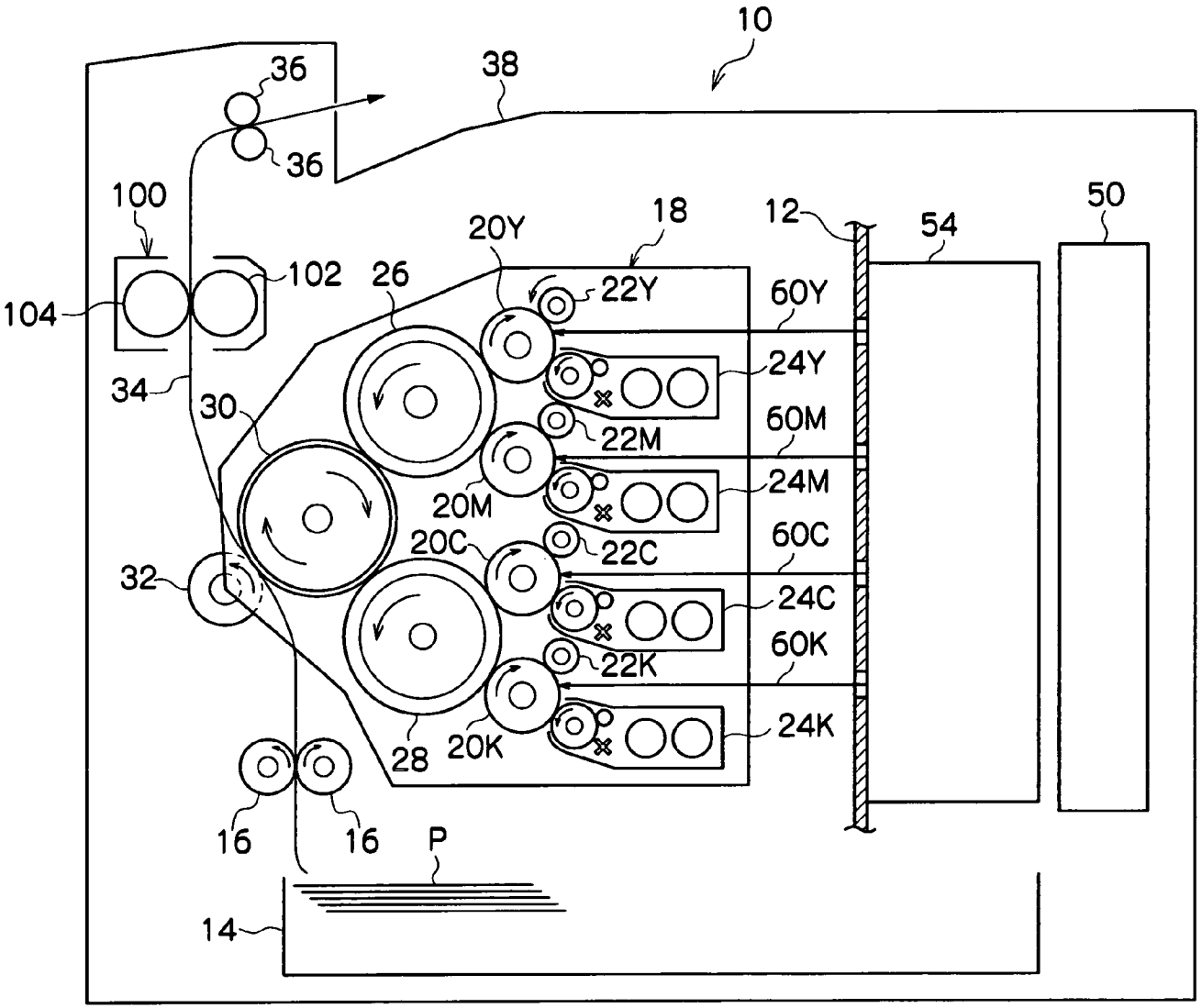
FIG. 1 is an overall view of an image forming device relating to a first exemplary embodiment of the present invention.

A printer 10 serving as an image forming device is shown in FIG. 1.

At the printer 10, a light scanning device 54 is fixed to a housing 12 which structures the main body of the printer 10. A control unit 50, which controls the operations of the respective portions of the light scanning device 54 and the printer 10, is provided at a position adjacent to the light scanning device 54.

The light scanning device 54 scans, by a rotating polygon mirror, light beams exiting from unillustrated light sources, and reflects the light beams at plural optical parts such as reflecting mirrors and the like, and emits light beams 60Y, 60M, 60C, 60K corresponding to respective toners of yellow (Y), magenta (M), cyan (C), and black (K).

The light beams 60Y, 60M, 60C, 60K are guided to photosensitive bodies 20Y, 20M, 20C, 20K corresponding respectively thereto.

A sheet tray 14 which accommodates recording sheets P is provided at the lower side of the printer 10. A pair of resist rollers 16, which adjust the position of the leading end portion of the recording sheet P, is provided above the sheet feed tray 14.

An image forming unit 18 is provided at the central portion of the printer 10. The image forming unit 18 has the aforementioned four photosensitive bodies 20Y, 20M, 20C, 20K, and these are lined-up in a row in the vertical direction.

Charging rollers 22Y, 22M, 22C, 22K, which charge the surfaces of the photosensitive bodies 20Y, 20M, 20C, 20K, are provided at the upstream sides in the directions of rotation of the photosensitive bodies 20Y, 20M, 20C, 20K.

Developing devices 24Y, 24M, 24C, 24K, which develop the toners of Y, M, C, K on the photosensitive bodies 20Y, 20M, 20C, 20K respectively, are provided at the downstream sides in the directions of rotation of the photosensitive bodies 20Y, 20M, 20C, 20K.

On the other hand, a first intermediate transfer body 26 contacts the photosensitive bodies 20Y, 20M, and a second intermediate transfer body 28 contacts the photosensitive bodies 20C, 20K. A third intermediate transfer body 30 contacts the first intermediate transfer body 26 and the second intermediate transfer body 28.

A transfer roller 32 is provided at a position opposing the third intermediate transfer body 30. The recording sheet P is conveyed between the transfer roller 32 and the third intermediate transfer body 30, and the toner image on the third intermediate transfer body 30 is transferred onto the recording sheet P.

A fixing device 100 is provided downstream of a sheet conveying path 34 at which the recording sheet P is conveyed. The fixing device 100 has a fixing belt 102 and a pressure-applying roller 104, and heats and applies pressure to the recording sheet P so as to fix the toner image on the recording sheet P.

The recording sheet P on which the toner image has been fixed is discharged-out by sheet conveying rollers 36 to a tray 38 which is provided at the top portion of the printer 10.

The image formation of the printer 10 will be described next.

When image formation starts, the surfaces of the respective photosensitive bodies 20Y through 20K are charged uniformly by the charging rollers 22Y through 22K.

The light beams 60Y through 60K which correspond to the output image are illuminated from the light scanning device 54 onto the surfaces of the charged photosensitive bodies 20Y through 20K, such that electrostatic latent images corresponding to respective color-separated images are formed on the photosensitive bodies 20Y through 20K.

The developing devices 24Y through 24K selectively furnish toners of the respective colors, i.e., Y through K, to the electrostatic latent images, and toner images of the colors Y through K are formed on the photosensitive bodies 20Y through 20K.

Thereafter, the magenta toner image is primarily transferred from the photosensitive body 20M for magenta onto the first intermediate transfer body 26. Further, the yellow toner image is primarily transferred from the photosensitive body 20Y for yellow onto the first intermediate transfer body 26, and is superposed on the magenta toner image on the first intermediate transfer body 26.

On the other hand, similarly, the black toner image is primarily transferred from the photosensitive body 20K for black onto the second intermediate transfer body 28. Further, the cyan toner image is primarily transferred from the photosensitive body 20C for cyan onto the second intermediate transfer body 28, and is superposed on the black toner image on the second intermediate transfer body 28.

The toner images of magenta and yellow, which have been primarily transferred onto the first intermediate transfer body 26, are secondarily transferred onto the third intermediate transfer body 30. On the other hand, the black and cyan toner images, which have been primarily transferred onto the second intermediate transfer body 28, as well are secondarily transferred onto the third intermediate transfer body 30.

The magenta and yellow toner images, which are secondarily transferred first, and the cyan and black toner images are superposed one on another here, and a full-color toner image of colors (three colors) and black is formed on the third intermediate transfer body 30.

The full color toner image which has been secondarily transferred reaches the nip portion between the third intermediate transfer body 30 and the transfer roller 32. Synchronously with the timing thereof, the recording sheet P is conveyed from the resist rollers 16 to the nip portion, and the full color toner image is tertiarily transferred onto the recording sheet P (final transfer).

Thereafter, this recording sheet P is sent to the fixing device 100, and passes through the nip portion of the fixing belt 102 and the pressure-applying roller 104. At this time, the full color toner image is fixed to the recording sheet P due to the working of the heat and pressure which are provided from the fixing belt 102 and the pressure-applying roller 104. After fixing, the recording sheet P is discharged-out to the tray 38 from the sheet conveying rollers 36, and the formation of a full color image on the recording sheet P is completed.

The fixing device 100 relating to the present exemplary embodiment will be described next.

Figure 2A:
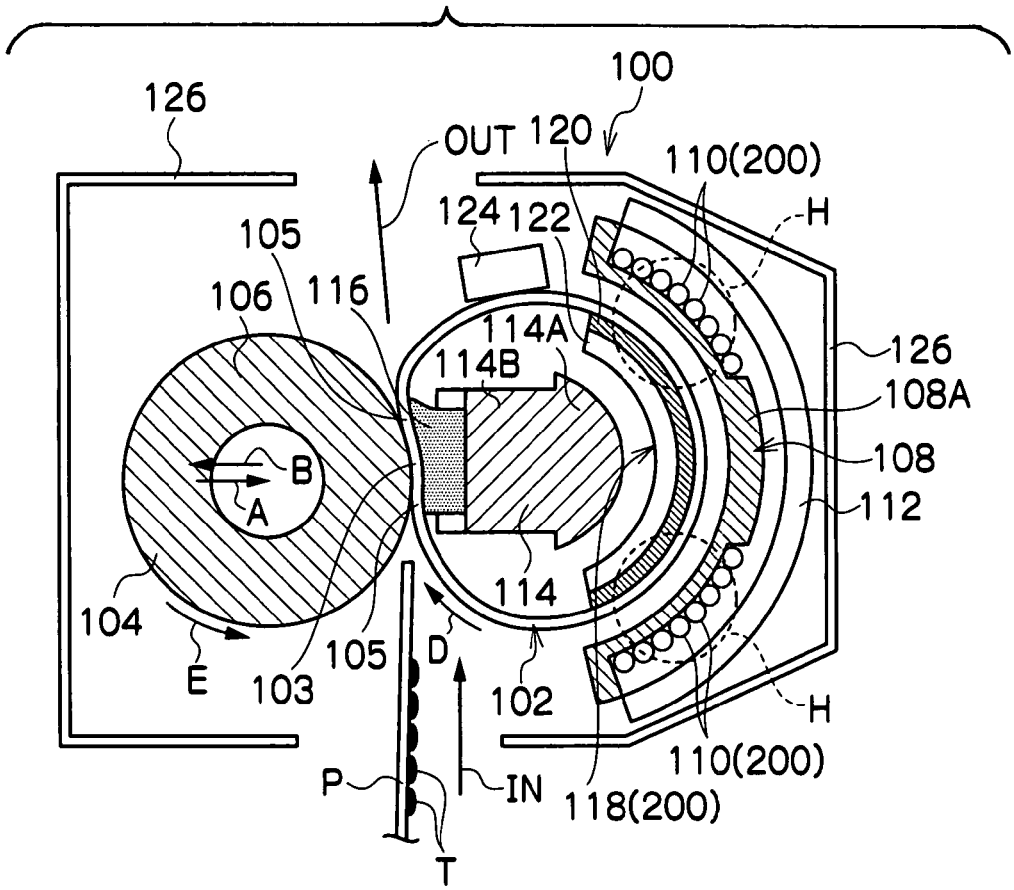
FIG. 2A is a cross-sectional view of a fixing device relating to the first exemplary embodiment of the present invention.

As shown in FIG. 2A, the fixing device 100 has a housing 126 in which are formed openings for the entry and discharging of the recording sheet P.

The fixing belt 102, which is endless and rotates in the direction of arrow D, is provided within the housing 126.

Figure 2B:
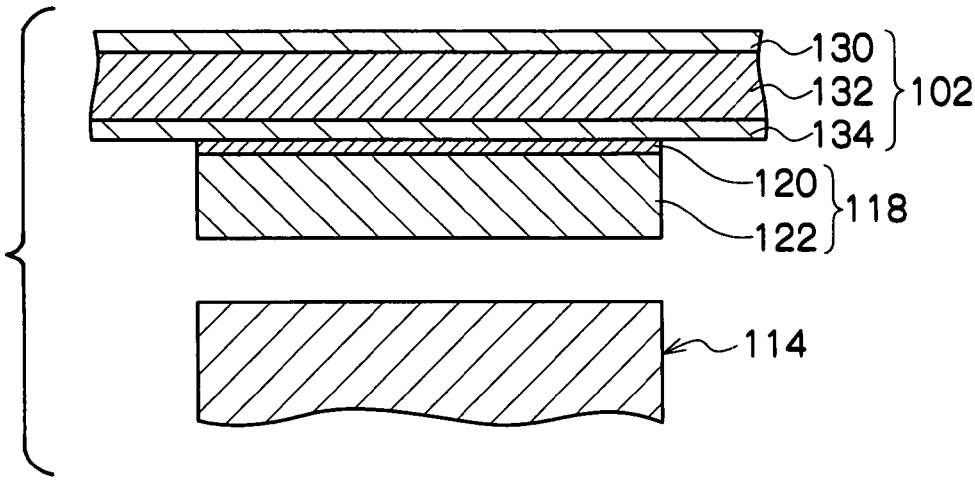
FIG. 2B is a cross-sectional view of a fixing belt and a heat generating body relating to the first exemplary embodiment of the present invention.

As shown in FIG. 2B, the fixing belt 102 is structured by a base layer 134, an elastic layer 132, and a releasing layer 130 from the inner side toward the outer side thereof. These layers are laminated together and made integral.

It is preferable that the base layer 134 be structured by a non-magnetic body (a paramagnetic body whose relative magnetic permeability is approximately 1) which can maintain the mechanical strength of the fixing belt 102 and which itself has difficulty in generating heat due to electromagnetic induction. Therefore, in the present exemplary embodiment, non-magnetic SUS is used as the base layer 134, and the thickness thereof is 50 μm.

From the standpoint of obtaining excellent elasticity and heat resistance, and the like, a silicon rubber or a fluorine rubber is preferably used as the elastic layer 132. In the present exemplary embodiment, silicon rubber is used. The thickness of the elastic layer 132 in the present exemplary embodiment is 200 μm.

The releasing layer 130 is provided in order to weaken the adhesive force with toner T (see FIG. 2A) which is fused on the recording sheet P, and make the recording sheet P peel-away easily from the fixing belt 102. In order to obtain excellent surface releasability, it is preferable to use a fluorine resin, silicon resin, or polyimide resin as the releasing layer 130. PFA (tetrafluoroethylene—perfluoroalkoxyethylene copolymer resin) is used in the present exemplary embodiment. The thickness of the releasing layer 130 is 10 μm.

As shown in FIG. 2A, a bobbin 108 formed of an insulating material is disposed at a position opposing the outer peripheral surface of the fixing belt 102. The interval between the bobbin 108 and the fixing belt 102 is about 1 to 3 mm. The bobbin 108 is formed in a substantial arc shape which follows the outer peripheral surface of the fixing belt 102. A convex portion 108A projects-out from the bobbin 108.

A excitation coil 110 is wound plural times in the axial direction (the direction perpendicular to the surface of the drawing of FIG. 2A) at the bobbin 108, with the convex portion 108A being the center. The excitation coil 110 is energized by an energizing circuit 144 which will be described later, and generates a magnetic field H.

A magnetic core 112, which is formed in a substantial arc shape which follows the arc shape of the bobbin 108, is disposed at a position opposing the excitation coil 110, and is supported at the bobbin 108.

On the other hand, a heat generating body 118 is provided at the inner side of the fixing belt 102. The heat generating body 118 planarly-contacts the inner peripheral surface of the fixing belt 102, and generates heat and raises the temperature of the fixing belt 102 to a set fixing temperature.

Here, a heating device 200 is structured by the excitation coil 110 (including the energizing circuit 144 which will be described later) and the heat generating body 118.

An induction body 114 is provided at the inner side of the fixing belt 102 so as to not contact the heat generating body 118. The induction body 114 and the heat generating body 118 are separated by 1.0 to 1.5 mm.

The induction body 114 is formed from aluminum which is a non-magnetic body, and is structured by an arc-shaped portion 114A which opposes the heat generating body 118, and a column portion 114B which is formed integrally with the arc-shaped portion 114A. Both ends of the induction body 114 are fixed to an unillustrated housing of the fixing device 100. Further, the arc-shaped portion 114A of the induction body 114 is disposed in advance at a position at which it induces magnetic flux of the magnetic field H when the magnetic flux of the magnetic field H passes through the fixing belt 102.

A pushing member 116, which is for pushing the fixing belt 102 toward the outer side at a predetermined pressure, is fixed to an end surface of the column portion 114B of the induction body 114. In this way, there is no need to provide members which support the induction body 114 and the pushing member 116 respectively, and the fixing device 100 can be made more compact.

The pushing member 116 is formed by a member which is elastic, such as urethane rubber, sponge, or the like. One end surface of the pushing member 116 contacts the inner peripheral surface of the fixing belt 102 and pushes the fixing belt 102.

On the other hand, the pressure-applying roller 104 is disposed at a position opposing the outer peripheral surface of the fixing belt 102. The pressure-applying roller 104 applies pressure to the fixing belt 102 toward the pushing member 116, and rotates in the direction of arrow E by a driving mechanism formed from an unillustrated motor and gears.

The pressure-applying roller 104 is structured such that the periphery of a core metal 106, which is formed from a metal such as aluminum or the like, is covered by silicon rubber and PFA. Further, the pressure-applying roller 104 can move in the directions of arrows A and B by using a cam mechanism or an electromagnetic switch such as a solenoid or the like (none of which is illustrated). When the pressure-applying roller 104 moves in the direction of arrow A, it contacts and applies pressure to the outer peripheral surface of the fixing belt 102. When the pressure-applying roller 104 moves in the direction of arrow B, it moves apart from the outer peripheral surface of the fixing belt 102.

Here, when the pressure-applying roller 104 applies pressure to the fixing belt 102 toward the pushing member 116, at the contact portion (the nip portion) of the fixing belt 102 and the pressure-applying roller 104, a concave portion 103 is formed at the fixing belt 102, and convex portions 105 are formed at both sides of the concave portion 103.

The shape of this nip portion is a shape which is curved in a direction of causing the recording sheet P to peel away from the fixing belt 102 when the recording sheet P carrying the toner T passes through. Therefore, the recording sheet P, which is conveyed-in from the direction of arrow IN, follows the shape of the nip portion due to the stiffness of the recording sheet P, and is discharged in the direction of arrow OUT.

The pushing member 116 pushes the fixing belt 102 toward the pressure-applying roller 104, and curves so as to follow the inner peripheral surface of the fixing belt 102, and widens the surface area of the nip portion.

A thermistor 124, which measures the temperature of the surface of the fixing belt 102, is provided so as to contact a region at the surface of the fixing belt 102 which region does not oppose the excitation coil 110 and is at the recording sheet P discharging side. The position of contact of the thermistor 124 is a substantially central portion in the axial direction of the fixing belt (the direction perpendicular to the surface of the drawing of FIG. 2), such that the measured value thereof does not change in accordance with the magnitude of the size of the recording sheet P.

The thermistor 124 measures the temperature of the surface of the fixing belt 102 due to the resistance value varying in accordance with the amount of heat provided from the surface of the fixing belt 102.

Figure 3:
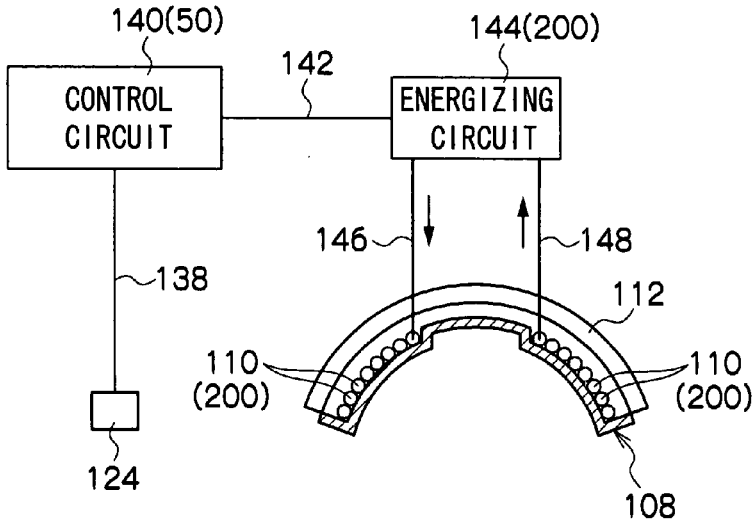
FIG. 3 is a connection diagram of a control circuit and an energizing circuit relating to the first exemplary embodiment of the present invention.

As shown in FIG. 3, the thermistor 124 is connected, via a wire 138, to a control circuit 140 provided at the interior of the aforementioned control unit 50 (see FIG. 1). The control circuit 140 is connected to the energizing circuit 144 via a wire 142. The energizing circuit 144 is connected to the aforementioned excitation coil 110 via wires 146, 148.

Here, on the basis of an electrical amount sent from the thermistor 124, the control circuit 140 measures the temperature of the surface of the fixing belt 102, and compares this measured temperature and a set fixing temperature which is stored in advance (170° C. in the present exemplary embodiment). If the measured temperature is lower than the set fixing temperature, the control circuit 140 drives the energizing circuit 144 and energizes the excitation coil 110, and causes the magnetic field H (see FIG. 2A) serving as a magnetic circuit to be generated. On the other hand, if the measured temperature is higher than the set fixing temperature, the control circuit 140 stops the energizing circuit 144.

The energizing circuit 144 is driven or the driving thereof is stopped on the basis of an electric signal sent from the control circuit 140. The energizing circuit 144 supplies (in the directions of the arrows) or stops the supply of AC current of a predetermined frequency to the excitation coil 110 via the wires 146, 148. The frequency is preferably greater than or equal to 20 kHz. If the frequency is less than or equal to 20 kHz, it falls within a range which is audible by humans, and therefore, the generation of vibration noise becomes problematic. Further, the frequency being greater than or equal to 100 kHz is not practical for reasons such as a widely-used power source cannot be used, it is easy for loss and noise to increase, the power source becomes large, and the like.

The heat generating body 118 will be described next.

As shown in FIG. 2A and FIG. 2B, the heat generating body 118 is structured by a heat generating layer 120, which planarly-contacts the inner peripheral surface of the fixing belt 102, and a temperature-sensitive layer 122, which is disposed at the reverse side (the side opposite the fixing belt 102) of the heat generating layer 120. The heat generating layer 120 and the temperature-sensitive layer 122 are layered and made integral.

The heat generating layer 120 is a metal material which generates heat due to the working of electromagnetic induction in which eddy current flows so as to generate a magnetic field which cancels the magnetic field H (see FIG. 2A). For example, gold, silver, copper, aluminum, zinc, tin, lead, bismuth, beryllium, antimony, or a metal material which is an alloy thereof can be used. In the present exemplary embodiment, copper is used as the heat generating layer 120 in order to make the specific resistance be low at less than or equal to $2.7\times10^{-8}$ Ωcm and efficiently obtain the needed generated heat amount, and also from the standpoint of low cost.

Making the thickness of the heat generating layer 120 as thin as possible is good in order to shorten the warm-up time of the fixing device 100, and it is preferable that the thickness is 2 μm to 20 μm. Therefore, in the present exemplary embodiment, the thickness of the heat generating layer 120 is made to be 10 μm.

On the other hand, the temperature-sensitive layer 122 is structured from a metal such as iron, nickel, silicon, boron, niobium, copper, zirconium, cobalt, or the like, or from a metal soft magnetic material formed from an alloy thereof.

A material having a Curie temperature in a temperature region which is less than or equal to the heat-resistant temperature of the fixing belt 102 (the temperature at which deformation due to heat begins) and is greater than or equal to the set fixing temperature of the fixing device 100 (the fixing temperature needed at the fixing belt 102), is used for the temperature-sensitive layer 122. In the present exemplary embodiment, the heat-resistant temperature is 240° C. and the set fixing temperature is 170° C., and an Fe—Ni alloy whose Curie temperature is about 230° C. is used.

Note that, in the present exemplary embodiment, the set fixing temperature at the fixing device 100 and a set heating temperature at the heating device 200 are considered as being the same.

At temperatures lower than the Curie temperature, the temperature-sensitive layer 122 is a strong magnetic body, and causes the magnetic field H (see FIG. 2A) to penetrate in. Further, at temperatures higher than the Curie temperature, the temperature-sensitive layer 122 is a paramagnetic body, and causes the magnetic flux of the magnetic field H to easily pass through. Moreover, the temperature-sensitive layer 122 is disposed such that the heat from the heat generating layer 120 side is conducted toward the side opposite the excitation coil 110.

The thickness of the temperature-sensitive layer 122 is preferably 50 μm to 300 μm in order to realize a shortening in the warm-up time of the fixing device 100 and appropriately manifest the temperature-sensitive function (the function of sensing that the temperatures of the fixing belt and the heat generating layer 120 have reached a vicinity of the Curie temperature, and, at this temperature vicinity, changing from a strong magnetic body to a paramagnetic body and weakening the magnetic flux, and suppressing a rise in the temperatures of the fixing belt 102 and the heat generating layer 120). (A temperature-sensitive magnetic metal (a magnetic shunt alloy or the like), which is formed from an Fe—Ni alloy or an Fe—Ni—Cr alloy or the like, and generally has a specific resistance in the range of 50 to $100\times10^{-8}$ Ω·m, can be used as the heat generating body 118 if it has a thickness of 600 μm.)

The temperature-sensitive layer 122 is preferably thin so that the thermal capacity is small, from the standpoint of shortening the warm-up time. Further, it is preferable that it is difficult for the temperature-sensitive layer 122 itself to generate heat.

If the thickness of the temperature-sensitive layer 122 is greater than or equal to 300 μm, it generates heat easily in a state higher than the Curie temperature. In order for the temperature-sensitive layer 122 in the present exemplary embodiment to exhibit a so-called sensor function in order to suppress a state in which the temperatures of the fixing belt 102 and the heat generating layer 120 become too high, the temperature-sensitive layer 122 must be such that a state in which the temperature-sensitive layer 122 itself, due to its own heat generation, reaches the Curie temperature before the fixing belt 102 and the heat generating layer 120, does not arise.

A state higher than the Curie temperature is a state in which the magnetic flux easily passes-through the temperature-sensitive layer 122. Therefore, if the layer thickness is greater than 300 μm, there is a state in which it is even more easy for the temperature-sensitive layer 122 to generate heat.

Further, if the thickness of the temperature-sensitive layer 122 is too thin, the magnetic flux easily passes therethrough, and therefore, it is preferable that the thickness be greater than or equal to 30 μm.

In order for the temperature-sensitive function to be exhibited, a surface skin depth δ0, which expresses the approximate depth to which a magnetic field can penetrate, is preferably less than or equal to the 300 μm maximum thickness (the maximum thickness which is preferable) of the temperature-sensitive layer 122.

The surface skin depth δ0 of the temperature-sensitive layer 122 is given by formula (1). surface skin depth of temperature-sensitive layer 122

$$\delta 0 = 503\sqrt{\frac{\rho 1}{(\mu r2 \cdot f)}} \tag{1}$$

In formula (1), ρ1 is the specific resistance (electrical resistivity) of the temperature-sensitive layer 122, f is the frequency, and μr2 is the relative magnetic permeability (room temperature) of the temperature-sensitive layer 122.

Here, assuming that the surface skin depth δ0 of the temperature-sensitive layer 122 is 300 μm, if a specific resistance and a relative magnetic permeability, which are such that a thickness δ of the temperature-sensitive layer 122 becomes δ≦300 μm, are obtained based on formula (1) with f≧20 kHz being a necessary condition, then if, for example, $\rho1=70\times10^{-8}$ Ωm, it is necessary for the relative magnetic permeability μr2 to be greater than or equal to at least 100. Accordingly, a material that satisfies this condition should be appropriately selected.

In order for the minimum thickness (the minimum thickness which is preferable) of the temperature-sensitive layer 122 to be 30 μm, in a case in which a material which is $\rho1=70\times10^{-8}$ Ωm is used for example, with f≧20 kHz being a necessary condition, δ≦30 μm if μr2 is made to be greater than or equal to 10,000. For example, in a case in which the magnetic permeability of a material which is $\rho1=70\times10^{-8}$ Ωm is 400, the magnetic permeability can be increased by subjecting the material to thermal processing or the like in order to make the relative magnetic permeability of the material be greater than or equal to 10,000.

Note that the thickness of the temperature-sensitive layer in the present exemplary embodiment is 100 μm.

Operation of the first exemplary embodiment of the present invention will be described next.

As shown in FIGS. 1 through 3, the recording sheet P, which has undergone the above-described image forming process of the printer 10 and on which the toner T has been transferred, is sent to the fixing device 100.

At the fixing device 100, due to the control of the control unit 50, the pressure-applying roller 104 is set apart from the surface of the fixing belt 102 until the temperature of the surface of the fixing belt 102 reaches the set fixing temperature. When the temperature of the surface of the fixing belt 102 reaches the set fixing temperature, the pressure-applying roller 104 moves and contacts the surface of the fixing belt 102.

The temperature of the surface of the fixing belt 102 temporarily falls due to the contact with the pressure-applying roller 104, but, due to the heat generating layer 120 continuing to generate heat, the temperature of the surface of the fixing belt 102 reaches the set fixing temperature.

In this way, the temperature of the fixing belt 102 as a single unit can be raised without the pressure-applying roller 104 contacting the fixing belt 102 at the time of raising the temperature of the fixing belt 102. Therefore, the warm-up time can be shortened more than in a case in which the temperature is raised in a state in which the fixing belt 102 and the pressure-applying roller 104 contact one another.

Then, at the fixing device 100, the pressure-applying roller 104 starts driving and rotating in the direction of arrow E, and the fixing belt 102 is thereby slave-rotated in the direction of arrow D. At this time, on the basis of the aforementioned electric signal from the control circuit 140, the energizing circuit 144 is driven, and AC current is supplied to the excitation coil 110 of the heating device 200.

When AC current is supplied to the excitation coil 110, generation and extinction of the magnetic field H (see FIG. 2A) as a magnetic circuit at the periphery of the excitation coil 110 are repeated.

Then, when the magnetic field H traverses the heat generating layer 120 of the heat generating body 118 at the heating device 200, eddy current (not shown) is generated at the heat generating layer 120 such that a magnetic field which impedes changes in the magnetic field H arises.

The heat generating layer 120 generates heat in proportion to the magnitudes of the surface skin resistance of the heat generating layer 120 and the eddy current flowing at the heat generating layer 120, and the fixing belt 102 is heated thereby.

As shown in FIG. 3, the temperature of the surface of the fixing belt 102 is sensed by the thermistor 124. If the temperature has not reached the set fixing temperature of 170° C., the control circuit 140 controls and drives the energizing circuit 144 such that AC current of a predetermined frequency (20 kHz to 100 kHz) is passed to the excitation coil 110. Further, when the set fixing temperature is reached, the control circuit 140 stops control of the energizing circuit 144.

Then, as shown in FIG. 2, the recording sheet P which has been sent-into the fixing device 100 is heated and pushed by the fixing belt 102, at which the heat generating layer 120 generates heat and which has become the predetermined set fixing temperature (170° C.), and the pressure-applying roller 104, and the toner image is fixed to the surface of the recording sheet P.

When the recording sheet P is sent-out from the nip portion between the fixing belt 102 and the pressure-applying roller 104, due to its own rigidity, the recording sheet P attempts to advance straight in the direction along the nip portion, and therefore is peeled away from the fixing belt 102.

The recording sheet P which is discharged-out from the fixing device 100 is discharged onto the tray 38 by the sheet conveying rollers 36.

Operation of the temperature-sensitive layer 122 will be described next.

Figure 4A:
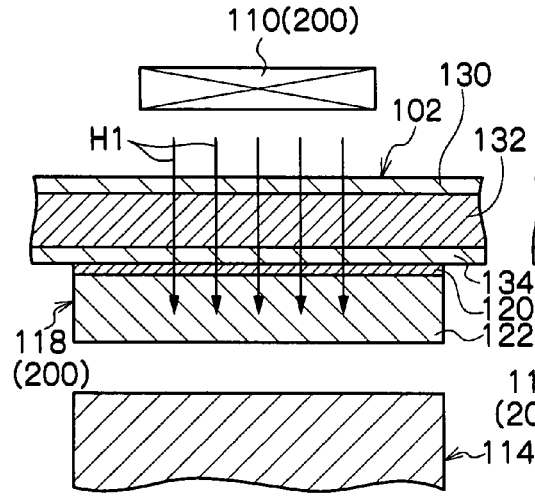
FIGS. 4A and 4B are schematic drawings showing states in which a magnetic field passes-through the fixing belt relating to the first exemplary embodiment of the present invention.
Figure 4B:
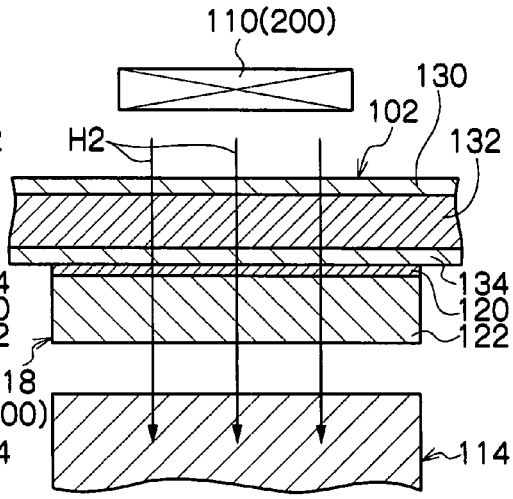

FIG. 4A shows a case in which the temperature of the temperature-sensitive layer 122 is less than or equal to the Curie temperature of the temperature-sensitive layer 122. FIG. 4B shows a case in which the temperature of the temperature-sensitive layer 122 exceeds the Curie temperature of the temperature-sensitive layer 122.

As shown in FIG. 4A, when the temperature of the temperature-sensitive layer 122 is less than or equal to the Curie temperature, the temperature-sensitive layer 122 is a strong magnetic body. Therefore, a magnetic field H1 which passes-through the heat generating layer 120 penetrates into the temperature-sensitive layer 122 and forms a closed magnetic path, and the magnetic field H1 is strengthened. In this way, a sufficient amount of generated heat of the heat generating layer 120 is obtained.

On the other hand, as shown in FIG. 4B, when the temperature of the temperature-sensitive layer 122 exceeds the Curie temperature, the temperature-sensitive layer 122 changes from a magnetic body to a paramagnetic body. Therefore, a magnetic field H2 weakens, and the magnetic field H2 can easily pass-through the temperature-sensitive layer 122.

In order to make the state of the magnetic field H1, which has passed through the heat generating layer 120, passing-through the temperature-sensitive layer 122 differ at the respective sides of the Curie temperature as in the present exemplary embodiment, a thickness t1 of the heat generating layer 120 and the thickness δ of the temperature-sensitive layer 122 must satisfy following formulas (2) and (3) at less than or equal to the Curie temperature of the temperature-sensitive layer 122, and must satisfy following formulas (2) and (4) at greater than the Curie temperature of the temperature-sensitive layer 122.

$$t1 < 503\sqrt{\frac{\rho 1}{(\mu r1 \cdot f)}} \tag{2}$$

$$\delta \geq 503\sqrt{\frac{\rho 2}{(\mu r2 \cdot f)}} \tag{3}$$

$$\delta \geq 503\sqrt{\frac{\rho 2}{(\mu r2 \cdot f)}} \tag{4}$$

In the above formulas, ρ1, t1, μr1 are respectively the specific resistance, the thickness, and the relative magnetic permeability of the heat generating layer 120, and ρ2, δ, μr2 are respectively the specific resistance, the thickness, and the relative magnetic permeability of the temperature-sensitive layer 122, and f is the frequency of the alternating magnetic field of the magnetic field generating unit (the excitation coil 110).

After the magnetic field H2 easily passes-through the temperature-sensitive layer 122, it further heads toward the induction body 114. Because the magnetic field H2 is induced by the induction body 114 at which it is the easiest for eddy current to flow, the eddy current amount of the heat generating layer 120 becomes small. Namely, because the induction body 114 is a non-magnetic body and the magnetic field H2 passes through, it becomes difficult for a closed magnetic path to form, and as a result, the magnetic flux density decreases, the magnetic field H2 weakens further, and the amount of generated heat of the heat generating layer 120 is decreased. In this way, the fixing belt 102 is not heated excessively at the border which is the vicinity of the Curie temperature of the temperature-sensitive layer 122.

Note that there are also cases in which eddy current is generated and generates heat due to a portion of the magnetic flux at the surface of the induction body 114. However, because the induction body 114 does not contact the fixing belt 102, it does not rob heat from the heat generating body 118 or the fixing belt 102, and therefore, does not affect the warm-up time.

A second exemplary embodiment of the heating device, the fixing device and the image forming device of the present invention will be described next on the basis of the drawings.

Note that parts which are basically the same as those of the above-described first exemplary embodiment are denoted by the same reference numerals as in the first exemplary embodiment, and description thereof is omitted.

Figure 5A:
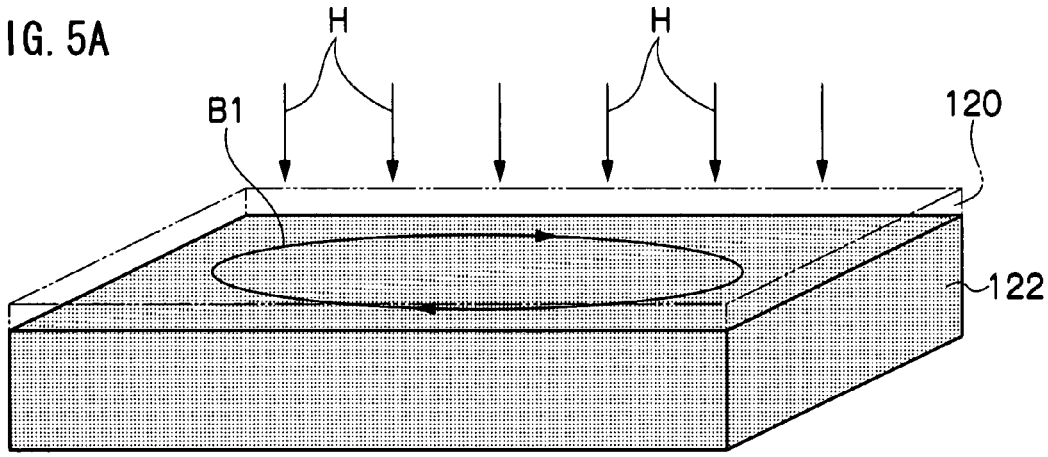
FIGS. 5A through 5C are schematic drawings of a temperature-sensitive layer of a heat generating body relating to a second exemplary embodiment of the present invention.

FIG. 5A schematically illustrates the heat generating layer 120 and the temperature-sensitive layer 122 of the above-described first exemplary embodiment in planar forms. Note that the heat generating layer 120 is shown by imaginary lines in order to illustrate the state of the temperature-sensitive layer 122.

As shown in FIG. 5A, when the magnetic field H is generated, eddy current B1 arises also at the top portion of the temperature-sensitive layer 122. The eddy current B1 forms a large flow path in the range over which the temperature-sensitive layer 122 is a continuous body.

Figure 5B:
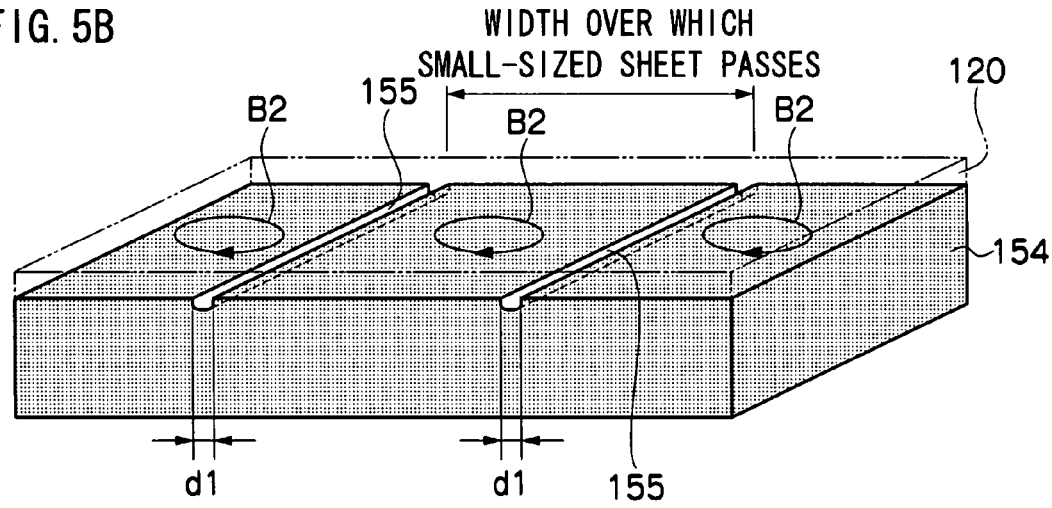

On the other hand, as shown in FIG. 5B, in the present exemplary embodiment, grooves 155 of a width d1 are formed along the peripheral direction of the above-described fixing member, in a surface portion 153 which is at the heat generating layer 120 side of a temperature-sensitive layer 154 which is structured of a material similar to that of the above-described temperature-sensitive layer 122.

The positions of the grooves 155 are positions corresponding to the both end portions of the small-sized recording sheet P (see FIG. 1) in the axial direction of the fixing belt 102. In this way, the temperature-sensitive layer 154 is sectioned into a central portion and two regions at the end portions.

The grooves 155 are formed to the predetermined width d1 and to a predetermined depth, such that eddy currents B2 are smaller than the aforementioned eddy current B1.

Figure 5C:
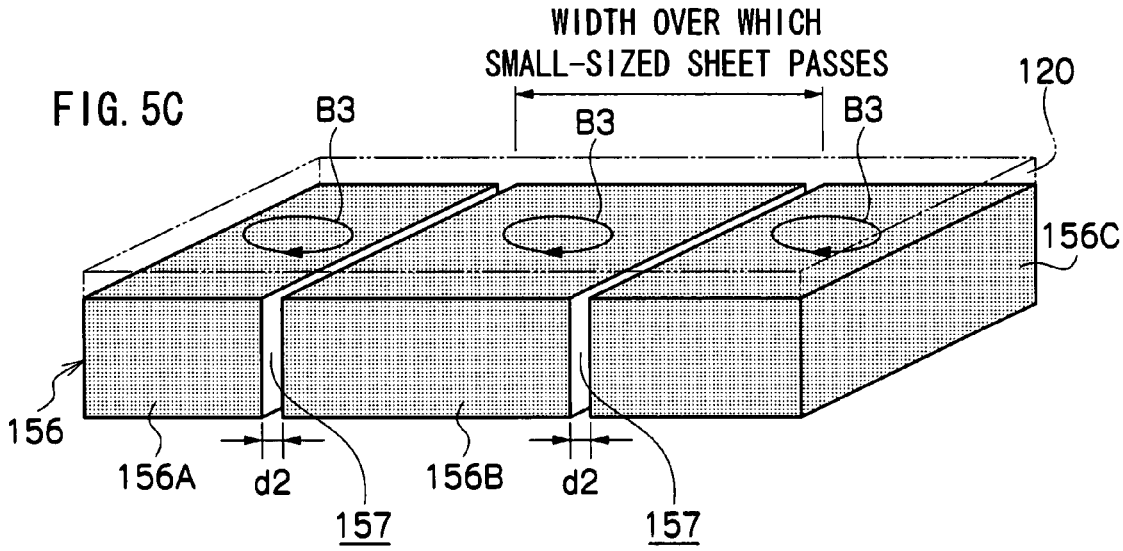

Further, as shown in FIG. 5C, a temperature-sensitive layer 156 is structured of a material which is similar to that of the above-described temperature-sensitive layer 122, and gap portions 157 of a width d2 are formed therein at positions corresponding to the both end portions of the small-sized recording sheet P (see FIG. 1). In this way, the temperature-sensitive layer 156 is sectioned into a central portion temperature-sensitive layer 156B which corresponds to the region of passage of the small-sized recording sheet P, and end portion temperature-sensitive layers 156A, 156C which corresponds to regions that the small-sized recording sheet P does not pass by.

The gap portions 157 are formed to the predetermined width d2 such that eddy currents B3 are smaller than the aforementioned eddy current B1. The gap portions are provided at two places in the present exemplary embodiment, but may be provided at two or more places in accordance with the sheet size. Providing more of the gap portions makes it possible to make the eddy current loss smaller, and therefore, the effect of further suppressing heat generation of the temperature-sensitive layer 122 itself is achieved. Further, this is preferable because it becomes difficult for heat to move in the axial direction due to the gap portions 157, and thus, it is easy for the temperature-sensitive layer 122 to accurately follow the temperature of the fixing belt 102, and therefore, the temperature sensing effect of the temperature-sensitive layer 122 is not weakened.

Operation of the second exemplary embodiment of the present invention will be described next.

A case in which the temperature-sensitive layer 154 is used will be described first.

As shown in FIG. 3, the control circuit 140 drives the energizing circuit 144 and energizes the excitation coil 110. The magnetic field H (see FIG. 2) is thereby generated.

As shown in FIG. 5B, when the temperature of the temperature-sensitive layer 154 is less than or equal to the Curie temperature, the temperature-sensitive layer 154 is a strong magnetic body. Therefore, the temperature-sensitive layer 154 is induced by the magnetic field H, and the eddy currents B2 are generated at the top surface side of the temperature-sensitive layer 154.

Here, because the eddy currents B2 of the temperature-sensitive layer 154 are smaller than the eddy current B1 of the above-described temperature-sensitive layer 122, the amount of generated heat of the temperature-sensitive layer 154 is small, and the fixing belt 102 (see FIG. 2) is not heated excessively.

On the other hand, if the temperature of the temperature-sensitive layer 154 is greater than or equal to the Curie temperature, the temperature-sensitive layer 154 is a paramagnetic body. Therefore, the magnetic field H passes-through the temperature-sensitive layer 154 and weakens, and the amount of generated heat of the heat generating layer 120 is suppressed.

Further, when fixing the small-sized recording sheets P (see FIG. 1) in succession, at the temperature-sensitive layer 154 at the region where the recording sheets P pass by, heat is robbed by the recording sheets P, and therefore, the temperature decreases and becomes lower than the Curie temperature.

On the other hand, at the temperature-sensitive layer 154 at the regions where the recording sheets P do not pass by, because heat is not robbed, the temperature increases and becomes higher than the Curie temperature. The magnetic property of the temperature-sensitive layer 154 disappears, the magnetic field at these regions weakens, and the magnetic field H passes-through the temperature-sensitive layer 154. In this way, the eddy currents B2 become small, the amount of generated heat of the heat generating layer 120 at these regions becomes small, and a rise in temperature is suppressed. An excessive rise in temperature of the regions of the fixing belt 102 where the recording sheets P do not pass by is prevented.

Note that, because the temperature-sensitive layer 154 is integral at regions other than the grooves 155, heat is obtained from the heat generating layer 120 and stored, which is effective in maintaining the temperature of the fixing belt 102.

A case in which the temperature-sensitive layer 156 is used will be described next.

As described above, as shown in FIG. 3, the control circuit 140 drives the energizing circuit 144 and energizes the excitation coil 110. The magnetic field H (see FIG. 2) is thereby generated.

As shown in FIG. 5C, when the temperature of the temperature-sensitive layer 156 is less than or equal to the Curie temperature, the temperature-sensitive layer 156 is a strong magnetic body. Therefore, the temperature-sensitive layer 156 is induced by the magnetic field H, and the eddy currents B3 are generated at the top surface side of the temperature-sensitive layer 156.

Here, because the eddy currents B3 of the temperature-sensitive layer 156 are smaller than the eddy current B1 of the above-described temperature-sensitive layer 122, the amount of generated heat of the temperature-sensitive layer 156 is small, and the fixing belt 102 (see FIG. 2) is not heated excessively.

On the other hand, if the temperature of the temperature-sensitive layer 156 is greater than or equal to the Curie temperature, the temperature-sensitive layer 156 is a paramagnetic body. Therefore, the magnetic field H passes-through the temperature-sensitive layer 156 and weakens, and the amount of generated heat of the heat generating layer 120 is suppressed.

Further, when fixing the small-sized recording sheets P (see FIG. 1) in succession, at the temperature-sensitive layer 156B which is at the region where the recording sheets P pass by, heat is robbed by the recording sheets P, and therefore, the temperature decreases and becomes lower than the Curie temperature, and the toner is fixed on the recording sheets P by the thermal energy of the heat generating layer 120.

On the other hand, at the temperature-sensitive layers 156A, 156C at the regions where the recording sheets P do not pass by, because heat is not robbed, the temperature rises and becomes higher than the Curie temperature, and the magnetic field H passes-through the temperature-sensitive layer 154. In this way, the eddy currents B3 become small, the temperature-sensitive layers 156A, 156C obtain heat from the heat generating layer 120, and an excessive rise in temperature of the regions of the fixing belt 102 where the recording sheets P do not pass by is prevented.

Note that, because the temperature-sensitive layer 156 is sectioned by the gap portions 157, the eddy currents B3 do not straddle the temperature-sensitive layers 156A, 156B, 156C, and can be made to be eddy current amounts which are certainly smaller than the eddy current B1 (see FIG. 5A). In this way, the fixing belt 102 is not heated excessively.

A third exemplary embodiment of the heating device, the fixing device and the image forming device of the present invention will be described next on the basis of the drawings.

Note that parts which are basically the same as those of the above-described first and second exemplary embodiments are denoted by the same reference numerals as in the first and second exemplary embodiments, and description thereof is omitted.

In the present exemplary embodiment, description is given of a case in which the heat generating layer is provided at the fixing belt.

Figure 6:
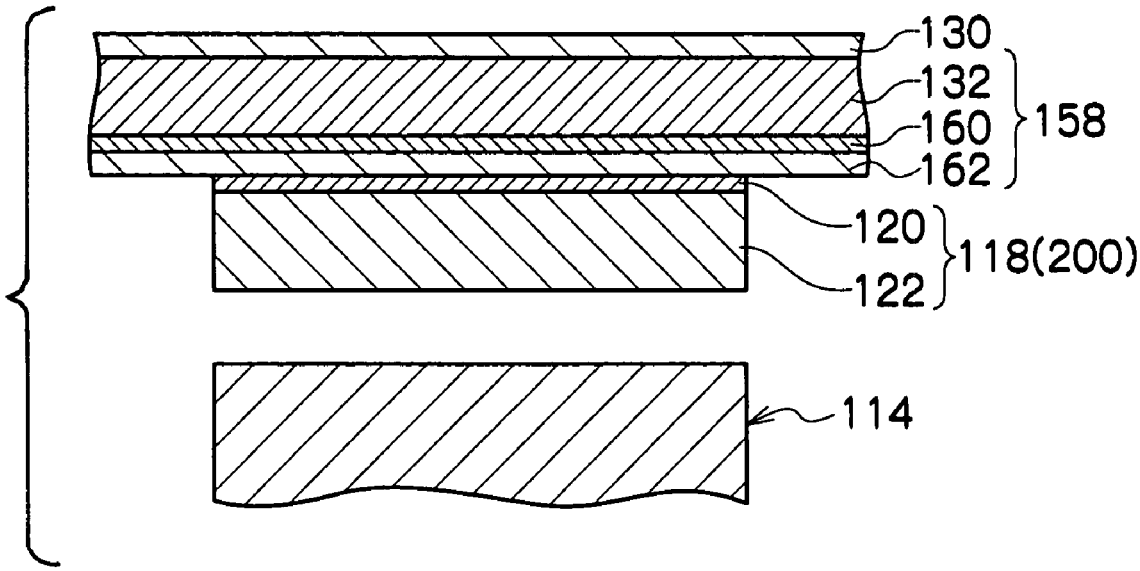
FIG. 6 is a cross-sectional view of a fixing belt relating to a third exemplary embodiment of the present invention.

As shown in FIG. 6, a fixing belt 158 is structured by a base layer 162, a heat generating layer 160, the elastic layer 132, and the releasing layer 130 from the inner side toward the outer side thereof. These layers are laminated together and made integral. The fixing belt 158 replaces the above-described fixing belt 102, and is mounted within the fixing device 100.

The base layer 162 is formed of polyimide, and the thickness thereof is 60 μm.

As the material of the heat generating layer 160, copper is ideal from the standpoint of lowering the thermal capacity, and from the standpoint of cost, and the like. The heat generating layer 160 is structured of copper and has a thickness of 2 to 20 μm, and the heat generating layer 120 of the heat generating body 118 also is structured of copper and has a thickness in a range of 2 to 20 μm. Here, the thicknesses of the heat generating layer 160 of the fixing belt 158 and the heat generating layer 120 of the heat generating body 118 are adjusted so as to satisfy the relationship of following formula (5).

$$t0 + t1 < 503\sqrt{\frac{\rho 0}{(\mu r0 \cdot f)}} + 503\sqrt{\frac{\rho 1}{(\mu r1 \cdot f)}} \quad (5)$$

In the above formula, ρ0, t0, μr0 are respectively the specific resistance, the thickness, and the relative magnetic permeability of the heat generating layer 160 within the fixing belt 158, and ρ1, t1, μr1 are respectively the specific resistance, the thickness, and the relative magnetic permeability of the heat generating layer 120, and f is the frequency of the alternating magnetic field of the magnetic field generating unit.

In the present exemplary embodiment, because both the heat generating layer 160 of the fixing belt 158 and the heat generating layer 120 of the heat generating body 118 are formed of copper, the thicknesses thereof are made to be a total of less than or equal to 20 μm. If the total thickness of both copper layers is greater than or equal to 20 μm, it becomes difficult for the two heat generating layers to generate heat in total, and therefore, adjustment is required. In the present exemplary embodiment, the copper thickness of the heat generating layer 160 is 10 μm, and the copper thickness of the heat generating layer 120 of the heat generating body 118 is 5 μm.

Note that, in the present exemplary embodiment, the heat-resistant temperature of the fixing belt 158 is 240° C., and the set fixing temperature is 170° C.

Operation of the third exemplary embodiment of the present invention will be described next.

As shown in FIG. 3, the control circuit 140 drives the energizing circuit 144 and energizes the excitation coil 110. The magnetic field H (see FIG. 2) is thereby generated.

Here, if the temperature of the temperature-sensitive layer 122 shown in FIG. 6 is less than or equal to the respective Curie temperatures, the temperature-sensitive layer 122 is a strong magnetic body. Therefore, the temperature-sensitive layer 122 is induced by the magnetic field H, and the heat generating layer 160, the heat generating layer 120, and the temperature-sensitive layer 122 generate heat. In this way, the fixing belt 158 is heated sufficiently. Note that, because the specific resistance of the temperature-sensitive layer 122 is high, the main portion of the amount of generated heat is furnished by the heat generating layer 160 and the heat generating layer 120. In the present exemplary embodiment, heat generation of the temperature-sensitive layer 122 is suppressed as much as possible, but since this layer also is metal, it generates heat due to electromagnetic induction. However, because the temperature-sensitive layer is basically overheated and the temperature thereof raised by the heat of the heat generating layer 160 and the heat generating layer 120, the temperature-sensitive layer 122 does not reach the Curie temperature due to its own generation of heat. Designing of the materials, such as the thicknesses, the magnetic permeabilities, the specific resistances, and the like thereof, is carried out such that the amount of generated heat of the temperature-sensitive layer 122 is smaller than those of the heat generating layer 160 and the heat generating layer 120.

On the other hand, if the temperature of the temperature-sensitive layer 122 is greater than or equal to the respective Curie temperatures, the temperature-sensitive layer 122 is a paramagnetic body, and therefore, the magnetic field H passes-through and the magnetic flux density weakens.

At the heat generating layer 160, due to the magnetic flux density weakening, the amount of eddy current decreases, and the amount of generated heat decreases. Further, the temperature-sensitive layer 122 weakens the magnetic flux density and robs heat from the heat generating layer 120. In this way, excessive heating of the fixing belt 158 is suppressed.

Further, when a small-sized recording sheet P (see FIG. 2) is passed through and fixed, at the region of the fixing belt 158 where the sheet passes by, heat is robbed by the recording sheet P and the temperature decreases to below the set fixing temperature. However, because the heat generating layer 160, the heat generating layer 120, and the temperature-sensitive layer 122 generate heat, a sufficient heat amount is furnished to the fixing belt 158, and the fixing belt 158 can be restored to the set fixing temperature.

On the other hand, the regions of the fixing belt 158 where the sheet does not pass by are heated without heat being robbed by the recording sheet P. Therefore, the temperature rises and becomes a high temperature which is greater than or equal to the set fixing temperature. However, the temperatures of the heat generating layer 160 and the temperature-sensitive layer 122 become greater than or equal to the respective Curie temperatures, the magnetic field H weakens, the amount of generated heat of the heat generating layer 160 decreases, and the temperature-sensitive layer 122 robs heat from the heat generating layer 120. In this way, excessive heating of the regions of the fixing belt 158 where the sheet does not pass by is suppressed.

Figure 7:
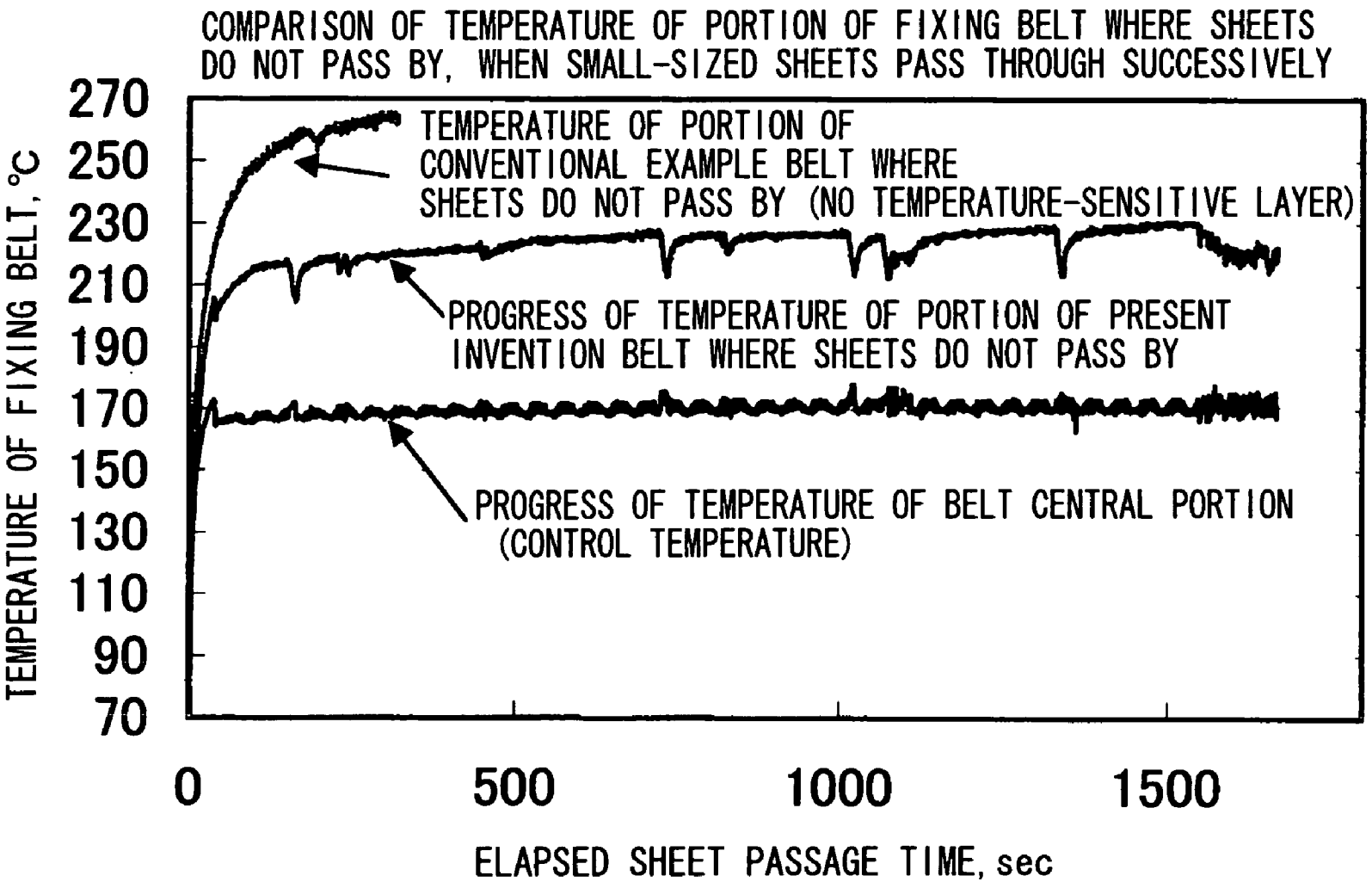
FIG. 7 is a graph comparing temperatures of a portion, where sheets do not pass by, of the fixing belt relating to the third exemplary embodiment of the present invention.

Effects of the present exemplary embodiment are shown in FIG. 7. FIG. 7 shows the progress of the temperature at a portion of the fixing belt 158 where sheets do not pass by, in a case in which 500 sheets of JD paper manufactured by Fuji Xerox Co., Ltd. are passed through in succession. As compared with a conventional heat generating body made of iron which does not use a heat generating body, a rise in temperature of the fixing belt 158 is suppressed in a vicinity of the Curie temperature of the temperature-sensitive layer 122 of the heat generating body 118 of the present exemplary embodiment, and the effects of the present exemplary embodiment are exhibited.

Note that the present invention is not limited to the above-described exemplary embodiments.

The printer 10 is not limited to a dry electrophotographic method using solid developers, and may be a printer which uses liquid developers.

As the unit which senses the temperature of the fixing belt 102, a thermocouple may be used instead of the thermistor 124.

The position at which the thermistor 124 is mounted is not limited to the surface of the fixing belt 102, and the thermistor 124 may be mounted at the inner peripheral surface of the fixing belt 102. In this case, it is difficult for the surface of the fixing belt 102 to become worn. Further, the thermistor 124 may be mounted to the surface of the pressure-applying roller 104.

The heating devices of the present exemplary embodiments are described as fixing devices. However, the present invention can also be applied to, for example, devices which heat air such as heaters of drying devices.

While the present invention has been illustrated and described with respect to specific exemplary embodiments thereof, it is to be understood that the present invention is by no means limited thereto and encompasses all changes and modifications which will become without departing from the scope of the appended claims.

What is claimed is:

1. A heating device comprising:

a magnetic field generating unit that generates a magnetic field; and a heat generating body including a heat generating layer which is disposed so as to oppose the magnetic field generating unit and which generates heat due to electromagnetic induction of the magnetic field, and a temperature-sensitive layer which has a Curie temperature from a set temperature of the heat generating layer to a heat-resistant temperature of the heat generating layer, and which is disposed at a side of the heat generating layer opposite a side at which the magnetic field generating unit is disposed, such that heat from the heat generating layer is conducted, wherein at temperatures less than or equal to the Curie temperature of the temperature-sensitive layer, the following formula (A) and formula (B) are satisfied, and, at temperatures exceeding the Curie temperature of the temperature-sensitive layer, the following formula (A) and formula (C) are satisfied:

$$t1 < 503\sqrt{\frac{\rho 1}{(\mu r1 \cdot f)}} \quad \text{formula (A)}$$

-continued $$\delta \geq 503\sqrt{\frac{\rho 2}{(\mu r2 \cdot f)}} \quad \text{formula (B)}$$

$$\delta \geq 503\sqrt{\frac{\rho 2}{(\mu r2 \cdot f)}} \quad \text{formula (C)}$$

wherein, in the above formulas, 1, t1, r1 are respectively a specific resistance, a thickness, and a relative magnetic permeability of the heat generating layer, and 2, r2 are respectively a specific resistance, a thickness, and a relative magnetic permeability of the temperature-sensitive layer, and f is a frequency of an alternating magnetic field of the magnetic field generating unit.

2. A fixing device comprising:

an endless fixing member, whose inner side contacts the heat generating body of the heating device of claim 1, and whose end portions are both rotatably supported;

a supporting body disposed at an inner side of the fixing member; and a pressure-applying rotating body which applies pressure to the fixing member toward the supporting body and rotates, and fixes a developer image, which is on a recording medium which passes through between the pressure-applying rotating body and the fixing member, onto the recording medium.

3. The fixing device of claim 2, wherein a heat generating layer within the fixing member, which generates heat due to magnetic induction of the magnetic field, is provided at an interior of the endless fixing member.

4. The fixing device of claim 3, wherein the heat generating layer of the heat generating body and the heat generating layer within the fixing member are structured so as to satisfy a relationship of the following formula (D):

$$t0 + t1 < 503\sqrt{\frac{\rho 0}{(\mu r0 \cdot f)}} + 503\sqrt{\frac{\rho 1}{(\mu r1 \cdot f)}} \quad \text{formula (D)}$$

where, in the above formula, 0, t0, r0 are respectively a specific resistance, a thickness, and a relative magnetic permeability of the heat generating layer within the fixing member, and 1, t1, r1 are respectively a specific resistance, a thickness, and a relative magnetic permeability of the heat generating layer, and f is a frequency of an alternating magnetic field of the magnetic field generating unit.

5. The fixing device of claims 4, wherein one of a groove and a gap, which is formed along a peripheral direction of the fixing member, is provided in a surface portion of a heat generating layer side of the temperature-sensitive layer.

6. The fixing device of claim 3, wherein a non-magnetic member, which is formed of a non-magnetic body and does not contact the heat generating body, is provided at a side of the heat generating body opposite a side where the magnetic field generating unit is disposed.

7. The fixing device of claim 6, wherein the non-magnetic member supports the supporting body.

8. The fixing device of claim 7, wherein one of a groove and a gap, which is formed along a peripheral direction of the fixing member, is provided in a surface portion of a heat generating layer side of the temperature-sensitive layer.

9. The fixing device of claim 3, wherein one of a groove and a gap, which is formed along a peripheral direction of the fixing member, is provided in a surface portion of a heat generating layer side of the temperature-sensitive layer.

10. The fixing device of claim 2, wherein a non-magnetic member, which is formed of a non-magnetic body and does not contact the heat generating body, is provided at a side of the heat generating body opposite a side where the magnetic field generating unit is disposed.

11. The fixing device of claim 10, wherein one of a groove and a gap, which is formed along a peripheral direction of the fixing member, is provided in a surface portion of a heat generating layer side of the temperature-sensitive layer.

12. The fixing device of claim 2, wherein one of a groove and a gap, which is formed along a peripheral direction of the fixing member, is provided in a surface portion of a heat generating layer side of the temperature-sensitive layer.

13. An image forming device comprising:

the fixing device of claims 2;

a sensing unit that senses a temperature of the fixing member of the fixing device; and a control unit that controls the magnetic field generating unit such that a temperature obtained by the sensing unit reaches a predetermined temperature.

14. The image forming device of claim 13, wherein the sensing unit is disposed at a central portion of the fixing member.

15. A fixing device comprising:

an endless fixing member, whose inner side contacts the heat generating body of the heating device of claim 1, and whose end portions are both rotatably supported;

a supporting body disposed at an inner side of the fixing member; and a pressure-applying rotating body which applies pressure to the fixing member toward the supporting body and rotates, and fixes a developer image, which is on a recording medium which passes through between the pressure-applying rotating body and the fixing member, onto the recording medium.

16. The fixing device of claim 15, wherein a heat generating layer within the fixing member, which generates heat due to magnetic induction of the magnetic field, is provided at an interior of the endless fixing member.

17. The fixing device of claim 16, wherein the heat generating layer of the heat generating body and the heat generating layer within the fixing member are structured so as to satisfy a relationship of the following formula (D):

$$t0 + t1 < 503\sqrt{\frac{\rho 0}{(\mu r0 \cdot f)}} + 503\sqrt{\frac{\rho 1}{(\mu r1 \cdot f)}} \qquad \text{formula (D)}$$

where, in the above formula, 0, t0, r0 are respectively a specific resistance, a thickness, and a relative magnetic permeability of the heat generating layer within the fixing member, and 1, t1, r1 are respectively a specific resistance, a thickness, and a relative magnetic permeability of the heat generating layer, and f is a frequency of an alternating magnetic field of the magnetic field generating unit.

* * * * *